US008303278B2

(12) United States Patent
Roof et al.

(10) Patent No.: US 8,303,278 B2
(45) Date of Patent: Nov. 6, 2012

(54) SCROLL COMPRESSOR UTILIZING LIQUID OR VAPOR INJECTION

(75) Inventors: Johnathan P. Roof, Tecumseh, MI (US); Anil Gopinathan, Hyderabad (IN); Damanjit Singh, Belleville, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 533 days.

(21) Appl. No.: 12/497,768

(22) Filed: Jul. 6, 2009

(65) Prior Publication Data

US 2010/0008807 A1 Jan. 14, 2010

Related U.S. Application Data

(60) Provisional application No. 61/078,958, filed on Jul. 8, 2008.

(51) Int. Cl.
*F01C 1/02* (2006.01)
*F03C 2/00* (2006.01)
*F03C 4/00* (2006.01)

(52) U.S. Cl. ..... 418/55.1; 418/15; 418/55.5; 418/57; 417/410.5; 417/902

(58) Field of Classification Search ..... 418/15, 418/55.1–55.6, 57, 97, 98; 417/310, 440, 417/410.5, 902
See application file for complete search history.

(56) References Cited

U.S. PATENT DOCUMENTS 4,889,471 A 12/1989 Izunaga et al.
5,076,067 A 12/1991 Prenger et al.
5,103,652 A 4/1992 Mizuno et al.
5,140,828 A 8/1992 Hagita et al.
5,253,489 A 10/1993 Yoshii et al.
5,329,788 A 7/1994 Caillat et al.
5,395,224 A 3/1995 Caillat et al.
5,447,420 A 9/1995 Caillat et al.
5,469,716 A 11/1995 Bass et al.
5,482,450 A 1/1996 Caillat et al.
5,640,854 A 6/1997 Fogt et al.
5,722,257 A 3/1998 Ishii et al.
5,833,442 A 11/1998 Park et al.
5,855,475 A 1/1999 Fujio et al.
6,017,205 A 1/2000 Weatherston et al.
(Continued)

FOREIGN PATENT DOCUMENTS

EP 0725255 A2 8/1996
(Continued)

*Primary Examiner* — Theresa Trieu
(74) *Attorney, Agent, or Firm* — Faegre Baker Daniels LLP

(57) ABSTRACT

A scroll compressor that utilizes liquid or vapor injection to cool a working fluid being compressed by an orbiting scroll member and a non-orbiting scroll member, and/or to increase the efficiency of the compressor. An injection fitting is secured to, and extends through, the compressor housing and receives liquid or vapor working fluid from a source external to the compressor. The non-orbiting scroll member may be fixedly mounted with respect to the crankcase of the compressor, and internal passages formed within the crankcase and the non-orbiting scroll member, which are substantially isolated from the suction pressure and discharge pressure chambers of the compressor, are used to convey liquid or vapor working fluid from the injection fitting into intermediate pressure working pockets defined between the scroll members. The compressor may include an end cap fitted over an open end of its housing which overlaps an end of the passage provided in the non-orbiting scroll member to provide a robust sealing of the passage.

18 Claims, 6 Drawing Sheets

U.S. PATENT DOCUMENTS

| | | | | |
|---|---|---|---|---|
| 6,089,839 | A | 7/2000 | Bush et al. | |
| 6,142,753 | A | 11/2000 | Bush et al. | |
| 6,162,033 | A * | 12/2000 | Moore et al. | 418/55.1 |
| 6,171,086 | B1 | 1/2001 | Lifson et al. | |
| 6,196,816 | B1 | 3/2001 | Lifson et al. | |
| 6,202,438 | B1 | 3/2001 | Barito | |
| 6,213,731 | B1 | 4/2001 | Doepker et al. | |
| 6,267,565 | B1 | 7/2001 | Seibel et al. | |
| 6,293,776 | B1 | 9/2001 | Hahn et al. | |
| 6,350,111 | B1 | 2/2002 | Perevozchikov et al. | |
| 6,379,131 | B1 | 4/2002 | Hoashi | |
| 6,419,457 | B1 | 7/2002 | Seibel et al. | |
| 6,430,959 | B1 | 8/2002 | Lifson | |
| 6,571,576 | B1 | 6/2003 | Lifson et al. | |
| 6,601,397 | B2 | 8/2003 | Pham et al. | |
| 6,615,598 | B1 | 9/2003 | Wham et al. | |
| 6,619,936 | B2 | 9/2003 | Perevozchikov | |
| 6,655,172 | B2 | 12/2003 | Perevozchikov et al. | |
| 6,679,683 | B2 | 1/2004 | Seibel et al. | |
| 6,773,242 | B1 | 8/2004 | Perevozchikov | |
| 7,063,523 | B2 | 6/2006 | Skinner | |
| 7,094,043 | B2 | 8/2006 | Skinner | |
| 7,100,386 | B2 | 9/2006 | Lifson | |
| 7,228,710 | B2 | 6/2007 | Lifson | |
| 7,381,037 | B2 | 6/2008 | Kim et al. | |
| 2006/0269432 | A1 | 11/2006 | Lifson | |
| 2006/0277931 | A1 | 12/2006 | Nakamura et al. | |
| 2007/0059193 | A1 | 3/2007 | Maladkar et al. | |
| 2007/0183915 | A1 | 8/2007 | Guo et al. | |
| 2007/0201996 | A1 | 8/2007 | Gopinathan | |
| 2008/0107555 | A1 | 5/2008 | Lifson | |
| 2008/0152526 | A1 | 6/2008 | Perevozchikov et al. | |
| 2008/0236179 | A1 | 10/2008 | Ignatiev et al. | |
| 2008/0256961 | A1 | 10/2008 | Lifson et al. | |
| 2008/0298992 | A1 | 12/2008 | Kakuda et al. | |
| 2008/0314057 | A1 | 12/2008 | Lifson et al. | |

FOREIGN PATENT DOCUMENTS

| | | | |
|---|---|---|---|
| JP | 60-259794 | A | 12/1985 |
| JP | 61-192890 | A | 8/1986 |
| JP | 63-243481 | A | 10/1988 |
| JP | 3-145589 | A | 6/1991 |
| JP | 4-12183 | A | 1/1992 |
| JP | 4-12184 | A | 1/1992 |
| JP | 4-22781 | A | 1/1992 |
| JP | 4-31683 | A | 2/1992 |
| JP | 8-247055 | A | 9/1996 |
| JP | 2003-74482 | A | 3/2003 |
| JP | 2003-74483 | A | 3/2003 |
| JP | 2004-271127 | A | 9/2004 |
| JP | 2005-90800 | A | 7/2005 |

* cited by examiner

SCROLL COMPRESSOR UTILIZING LIQUID OR VAPOR INJECTION

CROSS REFERENCE TO RELATED APPLICATIONS

This application claims the benefit under title 35, U.S.C. §119(e) of U.S. Provisional Patent Application Ser. No. 61/078,958, entitled COMPRESSOR UTILIZING LIQUID INJECTION, filed on Jul. 8, 2008, the disclosure of which is expressly incorporated by reference herein.

BACKGROUND OF THE INVENTION

1. Field of the Invention

The present invention relates to compressors and, in particular, to scroll compressors.

2. Description of the Related Art

In a typical scroll compressor, a motor and a compression mechanism are mounted within a hermetic housing. The compression mechanism includes a non-orbiting scroll member and an orbiting scroll member each having involute wraps in meshing engagement with one another. The orbiting scroll member is supported by a crankcase and driven by the motor. Specifically, the motor drives the crankshaft that, in turn, drives the orbiting scroll. Orbital movement of the orbiting scroll creates a series of variable volume working pockets between the involute wraps of the orbiting and non-orbiting scroll, with the volume of the working pockets progressively decreasing from an inlet to an outlet to compress of a working fluid.

During operation of a scroll compressor, the compression of the working fluid between the involute wraps of the orbiting and non-orbiting scrolls causes an increase in the temperature of the working fluid. As the working fluid progresses through the involute wraps, a portion of the heat generated in the working fluid is transferred to the involute wraps themselves. Additionally, when the compressor is undergoing extreme loading, the amount of heat generated during compression of the working fluid rises substantially. As a result of the rise in temperature of the working fluid, the working fluid expands and the mass flow of the working fluid, i.e., the total mass of working fluid that passes through a portion of the compression mechanism in a given time, is decreased which results in a decrease in the efficiency of the compressor.

It is generally known to inject working fluid, either in the form of a liquid or a vapor, from a suitable location in the working fluid circuit of which the compressor is a part, into the variable volume working pockets between the scroll members to aid in cooling the working fluid and/or the scroll members and/or to improve the efficiency of the compressor.

SUMMARY OF THE INVENTION

The present invention provides a scroll compressor that utilizes liquid or vapor injection to cool a working fluid being compressed by an orbiting scroll member and a non-orbiting scroll member, and/or to increase the efficiency of the compressor. An injection fitting is secured to, and extends through, the compressor housing and receives liquid or vapor working fluid from a source external to the compressor. The non-orbiting scroll member may be fixedly mounted with respect to the crankcase of the compressor, and internal passages formed within the crankcase and the non-orbiting scroll member, which are substantially isolated from the suction pressure and discharge pressure chambers of the compressor, are used to convey liquid or vapor working fluid from the injection fitting into intermediate pressure working pockets defined between the scroll members. The compressor may include an end cap fitted over an open end of its housing which overlaps an end of the passage provided in the non-orbiting scroll member to provide a robust sealing of the passage.

Advantageously, by providing for the injection of working fluid into an intermediate portion of the non-orbiting scroll member, the scroll members are cooled and/or the efficiency of the compressor is increased. In particular, the primary purpose of injecting liquid working fluid is to cause the injected liquid working fluid to absorb some of the thermal energy generated during compression to decrease the temperature of the working fluid and thereby decrease the temperature of the scroll members. The primary purpose of injecting working fluid in vapor form is to provide additional mass flow such that the overall mass of working fluid that undergoes compression is increased, correspondingly increasing the efficiency of the compressor.

In one form thereof, the present invention provides a scroll compressor, including a housing; a motor-compressor unit disposed within the housing, including: a motor including a stator and a rotor; a crankshaft fitted to the rotor; a crankcase rotatably supporting the crankshaft; a non-orbiting scroll member having a first involute wrap, the non-orbiting scroll member fixedly mounted with respect to the crankcase; and an orbiting scroll member having a second involute wrap, the crankshaft drivingly coupled to the orbiting scroll member to drive the orbiting scroll in an orbiting path with the first and second involute wraps cooperating to define a plurality of variable volume working pockets progressively decreasing in volume from an inlet to an outlet; an injection inlet fitting mounted to the housing and including a first passage; a second passage formed within the crankcase and in fluid communication with the first passage; and a third passage formed within the non-orbiting scroll member, the third passage in fluid communication with the second passage and with at least one of the variable volume working pockets.

In another form thereof, the present invention provides a scroll compressor, including a housing; an end cap fitted to the housing; an injection inlet fitting mounted to the housing; a motor-compressor unit disposed within the housing, including: a motor including a stator and a rotor; a crankshaft fitted to the rotor; a crankcase rotatably supporting the crankshaft; a non-orbiting scroll member, including: a first involute wrap; and a first passage formed within the non-orbiting scroll member and in fluid communication with the injection inlet, the first passage including an open end at an outer surface of the non-orbiting scroll member, the end cap covering the open end; and an orbiting scroll member having a second involute wrap, the crankshaft drivingly coupled to the orbiting scroll member to drive the orbiting scroll in an orbiting path with the first and second involute wraps cooperating to define a plurality of variable volume working pockets progressively decreasing in volume from an inlet to an outlet, at least one of the variable volume working pockets in fluid communication with the first passage.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates a preferred embodiment of the invention, in one form, and such exemplification is not to be construed as limiting the scope of the invention in any manner.

DETAILED DESCRIPTION

Figure 1A:
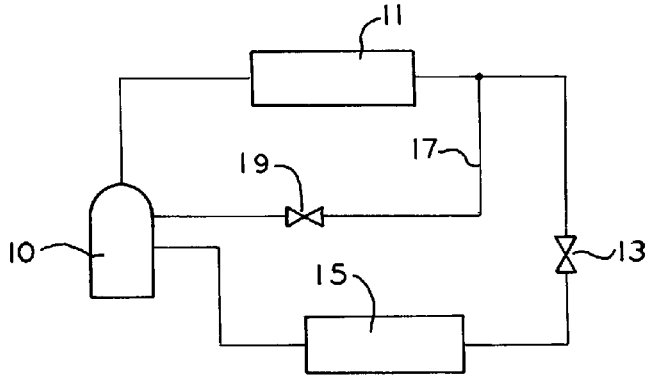
FIG. 1A is a schematic of an exemplary refrigeration circuit utilizing a scroll compressor with liquid injection.
Figure 1B:
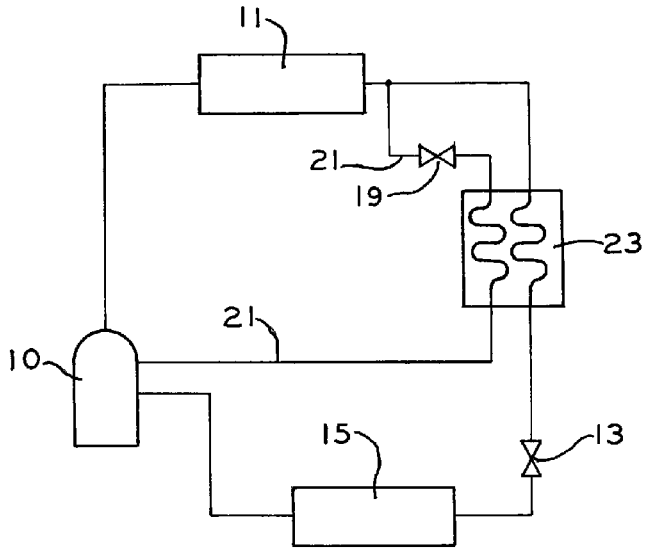
FIG. 1B is a schematic of an exemplary refrigeration circuit utilizing a scroll compressor with vapor injection.
Figure 2:
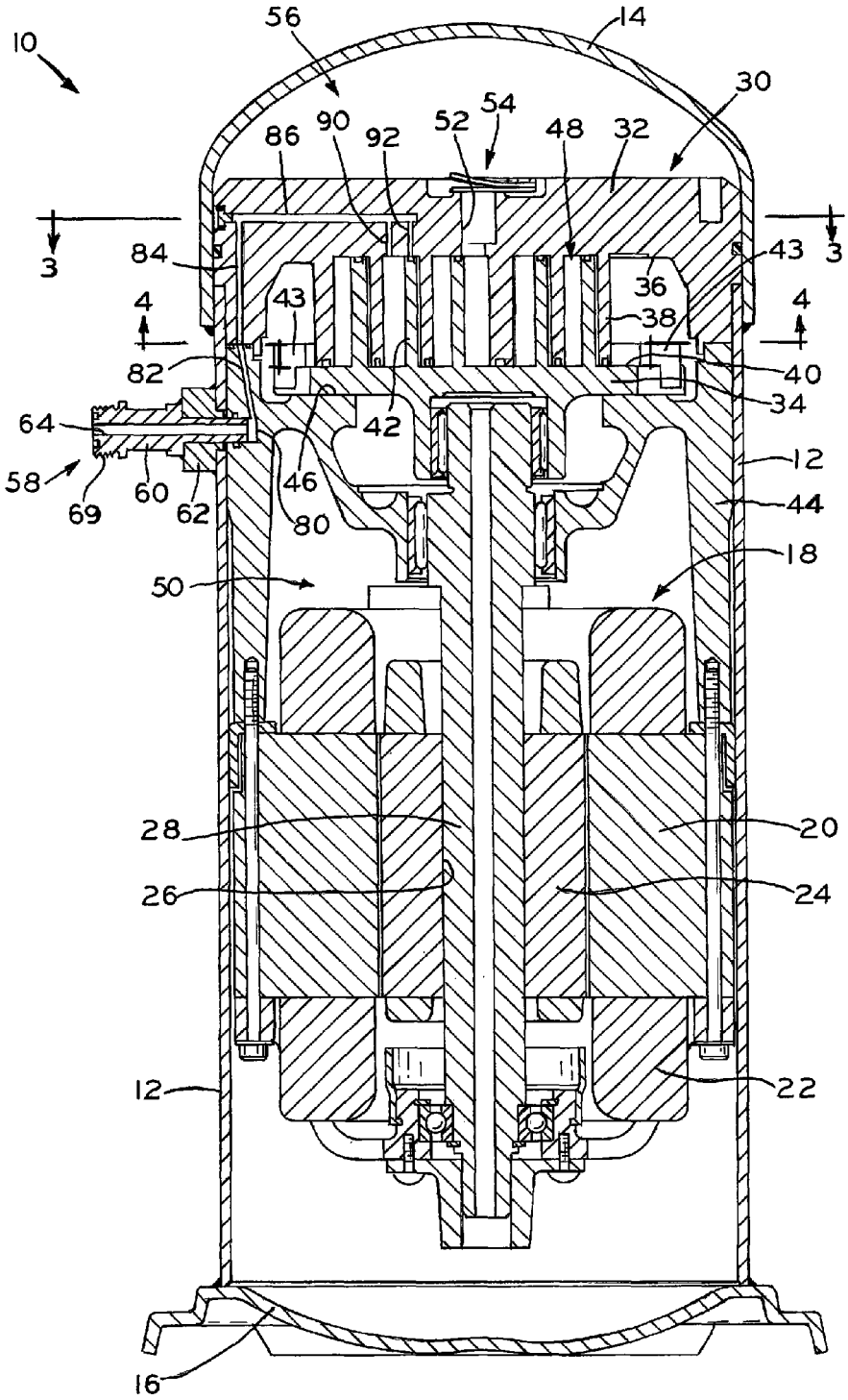
FIG. 2 is a cross-sectional view of a scroll compressor according to an exemplary embodiment.
Figure 3:
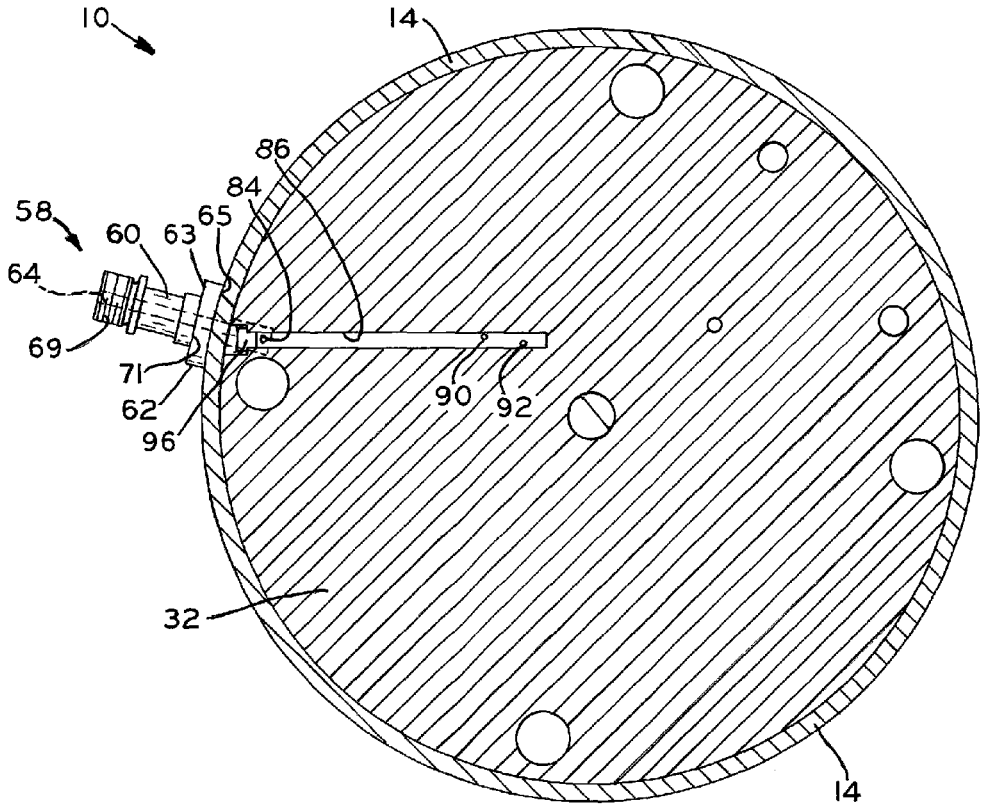
FIG. 3 is a cross-sectional view of the scroll compressor of FIG. 3 taken along line 3-3 of FIG. 2 and excluding the orbiting scroll.

Referring to FIG. 2, scroll compressor 10 is shown, which may be part of a working fluid circuit, such as the refrigeration circuits shown in FIGS. 1A and 1B in which the working fluid is a refrigerant. Referring to FIGS. 1A and 1B, the refrigeration circuits may each include a condenser 11, an expansion valve 13, and an evaporator 15 connected in series between an outlet and an inlet of compressor 10, as is well known. As will be discussed in further detail below, working fluid, such as refrigerant at an intermediate pressure that is obtained from a suitable location in the refrigeration circuit between the condenser and the evaporator, for example, may be injected into the working pockets defined between the scroll members of the compressor. In the circuit of FIG. 1A, liquid working fluid is obtained via a branch line 17 downstream of condenser 11, and the injection of the liquid working fluid in controlled via a suitable valve 19 in line 17. In the circuit of FIG. 1B, working fluid in vapor form is obtained via a branch line 21 downstream of condenser 11, after a portion of the working fluid in liquid form is first cooled by passing through an auxiliary heat exchanger 23, and the injection of the vapor is controlled via a suitable valve 19 in line 21.

Referring again to FIG. 2, compressor 10 includes a cylindrical main housing 12 having upper and lower end caps 14, 16 secured thereto, respectively. End caps 14, 16 are hermetically sealed to housing 12 by welding or brazing, for example. A motor-compressor unit is mounted within the interior of housing 12 and, as discussed below, generally includes a motor, crankshaft, crankcase, and a scroll set of non-orbiting and orbiting scroll members. Motor 18 is disposed within housing 12 and includes stator 20 with windings 22 through which electrical current may pass to induce rotation of rotor 24, which is disposed within stator 20. Crankshaft 28 extends through central aperture 26 in rotor 24, and is rotationally fixed to rotor 24, such as by an interference fit. Thus, during operation of motor 18, stator 20 causes rotation of rotor 24 that, correspondingly, rotates crankshaft 28.

Figure 5:
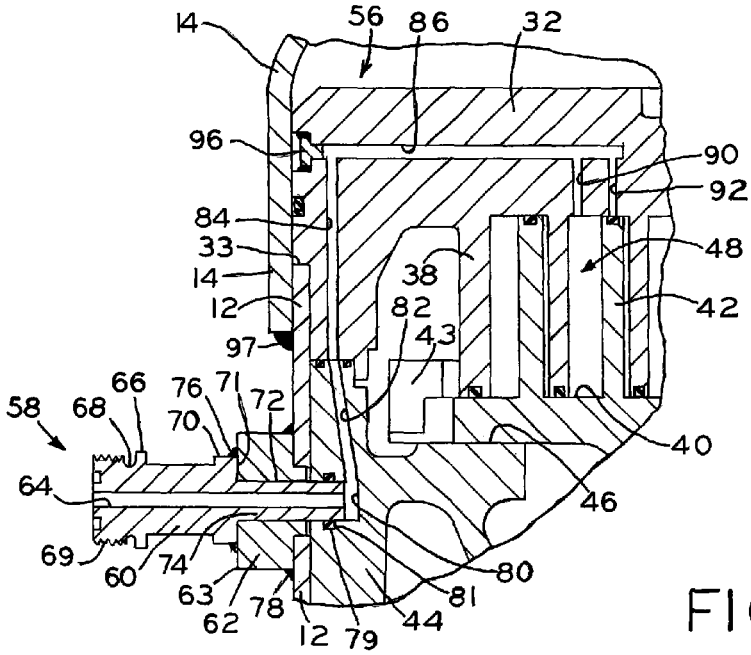
FIG. 5 is an enlarged, fragmentary view of a portion of the scroll compressor of FIG. 2.
Figures 6A, 6B:
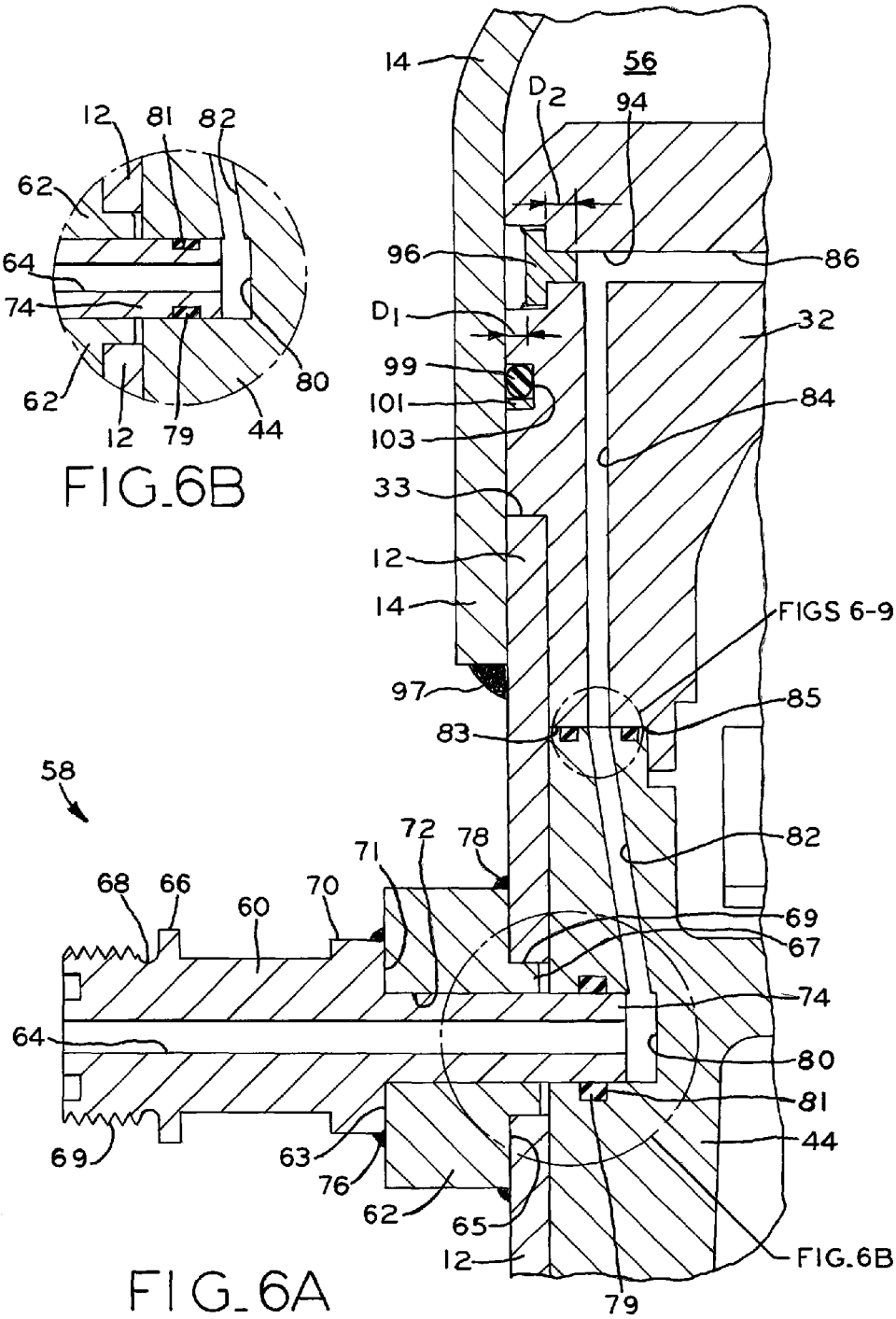
FIG. 6A is an enlarged, fragmentary view of a portion of FIG. 5.
FIG. 6B is a fragmentary view of a portion of FIG. 6A, showing an alternative embodiment.

Compression mechanism or scroll set 30 is driven by crankshaft 28, and includes non-orbiting scroll member 32 and orbiting scroll member 34. End cap 14 is fitted closely over the outer surface of non-orbiting scroll member 32, with the lower edge of end cap 14 being welded to the external surface of housing 12 as discussed below. As best shown in FIGS. 5 and 6A, non-orbiting scroll member 32 includes annular rim 33 which sits atop and abuts an upper annular end surface or edge of housing 12. In this manner, non-orbiting scroll member 32 extends across the upper end of housing 12 and divides the interior of housing 12 into a relatively low pressure suction chamber 50 disposed beneath non-orbiting scroll member 32, in which the components of the motor-compressor unit are disposed, and a relatively high pressure discharge chamber 56 disposed between non-orbiting scroll member 32 and the interior surface of end cap 14. Additionally, non-orbiting scroll member 32 includes a generally planar base plate portion having surface 36 from which involute non-orbiting scroll wrap 38 extends.

Similarly, orbiting scroll member 34 includes a generally planar base plate portion having surface 40 from which involute orbiting scroll wrap 42 extends. During operation of motor 18, crankshaft 28 orbitally drives orbiting scroll member 34, resulting in progressive compression of a working fluid as it travels through a plurality of variable-volume working pockets 48 formed between interleaved involute wraps 38, 42. Oldham coupling or ring 43 is operatively coupled between non-orbiting scroll member 32 and orbiting scroll member 34 to prevent rotation of orbiting scroll member 34, as is known.

Figure 4:
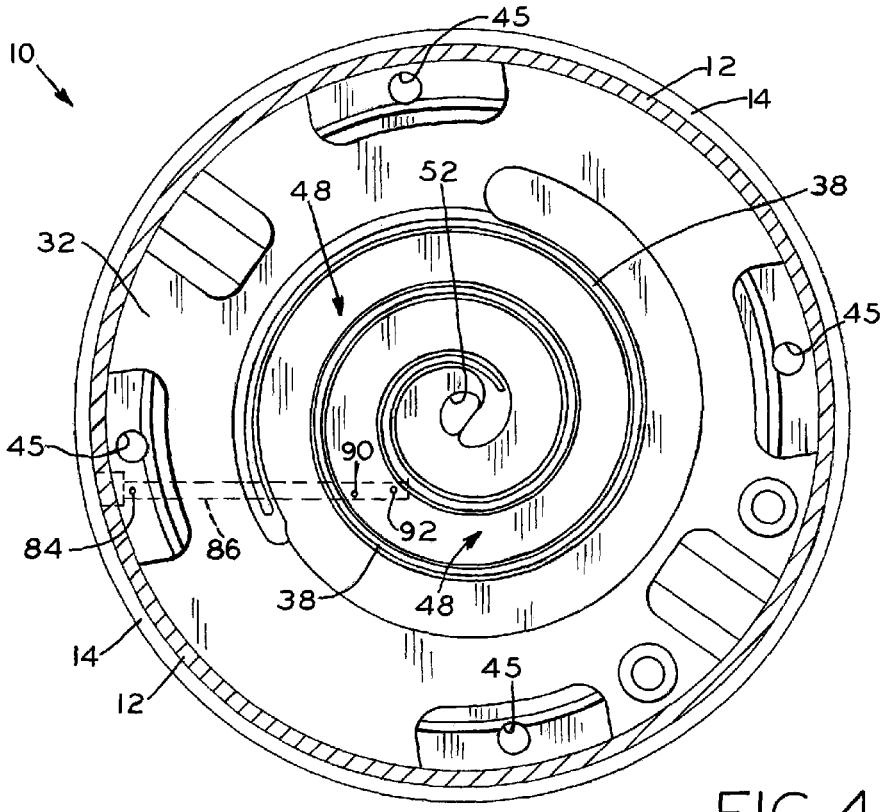
FIG. 4 is a cross-sectional view of the scroll compressor of FIG. 1 taken along line 4-4 of FIG. 2.

Crankcase 44 includes thrust surface 46 on which orbiting scroll member 34 is rotatably supported. Crankcase 44 is fixedly secured to non-orbiting scroll member 32 in a suitable manner, such as by a plurality of bolts (not shown) that extend into holes 45 (FIG. 4) of non-orbiting scroll member 32, such that non-orbiting scroll member 32 is fixed to, and does not move relative to, crankcase 44 in an axial direction parallel to crankshaft 28, as discussed further below. Further details regarding methods by which crankcase 44 may be mounted to non-orbiting scroll member 32, and by which the motor compressor unit may be mounted within housing 12, are described in U.S. patent application Ser. No. 11/742,779, filed on May 2, 2007, assigned to the assignee of the present invention, the disclosure of which is expressly incorporated by reference herein.

As indicated above, during operation of scroll compressor 10, orbiting scroll member 32 rotates on thrust surface 46 resulting in compression of working fluid within variable volume working pockets 48 between involute non-orbiting scroll wrap 38 and involute orbiting scroll wrap 42. Thus, during operation of compressor 10, working fluid is received within suction pressure chamber 50 of housing 12 via an inlet (not shown). This working fluid, which is at suction pressure, is drawn into the radially outermost working pocket 48 defined between the scroll members through an inlet between the scroll members and, as orbiting scroll 34 rotates, progresses toward the center of involute wraps 38, 42 as the working fluid is compressed. Once the working fluid reaches the center of involute wraps 38, 42, the working fluid has been compressed to a discharge pressure and exits via discharge passage 52 through discharge valve 54. The discharge pressure working fluid then enters discharge pressure chamber 56 and exits compressor 10 via a discharge outlet (not shown). Compressor 10 may include additional aspects and features such as those described in U.S. Pat. No. 7,094,043 to Skinner, issued Aug. 27, 2006, and U.S. Pat. No. 7,063,523 to Skinner, issued Jun. 20, 2006, the entire disclosures of which are expressly incorporated by reference herein.

In order to decrease the temperature of the working fluid during operation of compressor 10 and/or to increase the mass flow of the same, i.e., the total mass of working fluid that passes through a portion of the compression mechanism in a given time, working fluid in liquid or vapor form may be received via injection fitting assembly 58. As shown in FIG. 2, injection fitting assembly 58, in one exemplary embodiment, includes injection inlet fitting 60 and adapter fitting 62. While injection fitting assembly 58 is described and depicted herein as including both injection inlet fitting 60 and adapter fitting 62, injection fitting assembly 58 may, in other embodiments, be formed as a single, integral fitting.

Referring to FIGS. 2, 5, and 6A, injection inlet fitting 60 includes a passage 64 extending therethrough. Additionally, injection inlet fitting 60 includes a connection mechanism in the form of annular rib 66, groove 68, and threads 69 configured to facilitate releasable coupling of a supply conduit (not shown in FIGS. 2, 5, and 6A) of liquid working fluid from a refrigeration circuit, for example, to injection inlet fitting 60. While described herein with specific reference to annular rib 66, groove 68, and threads 69 the connection mechanism of injection inlet fitting 60 may be any known connection mechanism that facilitates a connection between a fitting and a hose or pipe, for example. Injection fitting 60 also includes second annular rib 70 defining a planar surface 71 configured to flushingly engage a corresponding planar surface 63 of adapter fitting 62.

Adapter fitting 62 includes bore 72 extending therethrough, which is sized to receive end portion 74 of injection inlet fitting 60 therethrough. Additionally, bore 72 has a diameter smaller than the outer diameter of annular rib 70. Thus, end portion 74 of injection inlet fitting is received through 72 of adapter fitting 62 until the planar surface 71 of annular rib 70 contacts the planar surface 63 of adapter fitting 62 and injection inlet fitting 60 is welded to adapter fitting 62 at this interface to form weld 76 to secure the components together.

Adapter fitting 62 also includes a surface 65, opposite planar surface 63, which may be planar, or may be concavely curved to match the curvature of the outer surface of compressor housing 12. With surface 65 of adapter fitting 62 positioned against the outer surface of compressor housing 12, these components are welded to form weld 78 to secure injection inlet fitting 60 and adapter fitting 62 to housing 12. As best shown in FIG. 6A, adapter fitting 62 may also include a projecting portion 67 received with opening 690 in housing 12.

As shown in FIGS. 2, 5, and 6A, and particularly in FIG. 6A, end portion 74 of injection inlet fitting 60 extends into recess 80 formed in crankcase 44, and an O-ring seal 79 is positioned between end portion 74 of injection inlet fitting 60 and a surface of crankcase 44 defining recess 80. O-ring seal 79 may be positioned within an annular recess 81 formed around crankcase recess 80, and provides a fluid tight seal between end portion 74 of injection inlet fitting 60 and crankcase 44. In alternate embodiments, recess 81 may be located within end portion 74 of injection inlet fitting 60 for receipt of O-ring seal 79, as shown in FIG. 6B and/or end portion 74 of injection inlet fitting 60 may be threaded into recess 80 of crankcase 44. During welding of the foregoing components at welds 76 and 78, adapter fitting 62 spaces the location of welds 76 and 78 from O-ring seal 79 and serves as a heat sink to reduce the potential for exposure of O-ring seal to excessive heat during the welding processes.

Referring primarily to FIG. 6A, passage 82 is formed internally within crankcase 44 and extends from, and is in fluid communication with, recess 80. Passage 82 extends from recess 80 toward non-orbiting scroll member 32 along a direction that is generally parallel to, or angled slightly with respect to, crankshaft 28, as may be seen in FIG. 2. Passage 82 extends to an end surface 83 of crankcase 44, best shown in FIGS. 6A-11, and is fluidly sealed with respect to passage 84 in non-orbiting scroll member 32 in the manner discussed in detail below.

Passages 84 and 86 each comprise portions of a passage arrangement formed internally within non-orbiting scroll member 32. Passage 84 includes a first, lower end extending to an end surface 85 of non-orbiting scroll member 32 and is in fluid communication with passage 82 in crankcase 44. Passage 84 also includes a second, upper end joined to, and in fluid communication with, passage 86. Passage 84 extends within non-orbiting scroll member 32 along a direction that is generally parallel to, or angled slightly with respect to, crankshaft 28, as may be seen in FIG. 2.

Passage 86 is also formed internally within non-orbiting scroll member 32, and extends between first and second ends thereof along a direction which is perpendicular to, or substantially perpendicular to, passage 84. Plug 96 is fitted within first end 94 of passage 86 to seal end 94 of passage 86, and passages 84 and 86 may each be formed in a linear fashion by boring or drilling in non-orbiting scroll 32, with passage 86 formed by drilling through the outer surface of non-orbiting scroll 32, followed by fitting plug 96 into end 94 and securing plug 96 by a press-fit, a screw thread, or by welding, for example. Advantageously, during assembly of compressor 10, end cap 14 fits over and covers end 94 of passage 86 and plug 96 when end cap 14 is closely fitted over non-orbiting scroll member 32, and end cap 14 is overlapped with and welded to housing 12 at 97. An O-ring seal 99 and a backer ring 101 are received within an annular recess 103 in the outer surface of non-orbiting scroll member 32 to provide a seal between end cap 14 and non-orbiting scroll member 32. In this manner, end cap 14 backs plug 96 to provide a redundancy to the sealing of end 94 of passage 86. Specifically, because a gap dimension $D_1$ in FIG. 6A, defined between plug 96 and the inner surface of end cap 14, is less than a dimension $D_2$ over which plug 96 extends into passage 86, even if the position of plug 96 should shift outwardly of passage 86, passage 86 will still be sealed by plug 96.

A pair of passages 90 and 92, shown in FIGS. 2-5, each extend from the second end of passage 86 along directions substantially perpendicular to passage 86, and are in respective fluid communication with intermediate pressure working pockets defined between the involute wraps 38 and 42 of non-orbiting scroll member 32 and orbiting scroll member 34. Typically, passages 90 and 92 will be in continuous fluid communication with a respective pair of intermediate pressure working pockets that are separate from one another, but may also be in continuous fluid communication with the same intermediate pressure working pocket, depending on the positions of passages 90 and 92 and/or the geometry of the involute wraps 38 and 42 of non-orbiting scroll member 32 and orbiting scroll member 34. Alternatively, and again depending on the positions of passages 90 and 92 and/or the geometry of the involute wraps 38 and 42 of non-orbiting scroll member 32 and orbiting scroll member 34, the foregoing conditions may alternate during operation of the compressor.

Referring to FIGS. 6A and 7-11, various sealing configurations for the interface between surface 83 of crankcase 44 and surface 85 of non-orbiting scroll member 32 will be described.

Figure 7:
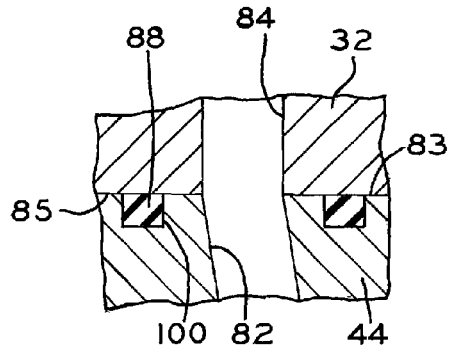
FIG. 7 is an enlarged, fragmentary view of a portion of FIG. 6A, showing a seal arrangement between the crankcase and the non-orbiting scroll passages according to a first embodiment.
Figure 8:
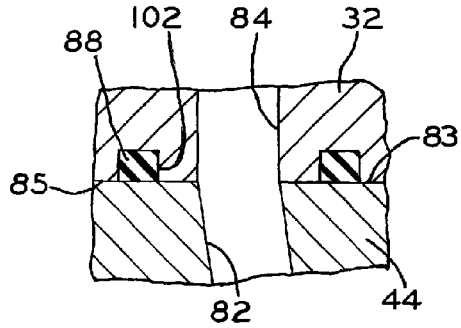
FIG. 8 is an enlarged, fragmentary view of a portion of FIG. 6A, showing a seal arrangement between the crankcase and the non-orbiting scroll passages according to a second embodiment.

In FIG. 7, an O-ring seal 88 is received within an annular recess 100 provided in surface 83 of crankcase 44, and is compressed upon engagement of surface 85 of non-orbiting scroll member 32 with surface 83 of crankcase 44 when non-orbiting scroll member 32 is fixedly secured to crankcase 44. In FIG. 8, O-ring seal 88 is received within an annular recess 102 provided in surface 85 of non-orbiting scroll member 32, and is compressed upon engagement of surface 85 of non-orbiting scroll member 32 with surface 83 of crankcase 44 when non-orbiting scroll member is fixedly secured to crankcase 44.

Figure 9:
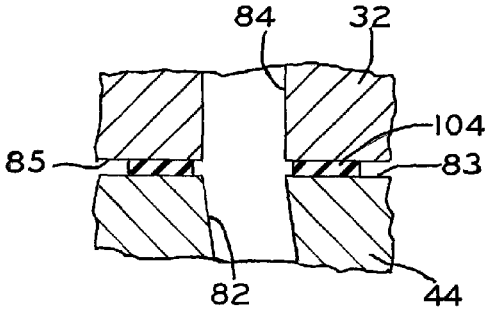
FIG. 9 is an enlarged, fragmentary view of a portion of FIG. 6A, showing a seal arrangement between the crankcase and the non-orbiting scroll passages according to a third embodiment.

In FIG. 9, a flat seal or gasket 104 is disposed between surfaces 83 of crankcase 44 and 85 of non-orbiting scroll member 32, respectively, and is captured under compression between these surfaces when non-orbiting scroll member 32 is fixedly secured to crankcase 44 wherein, in this arrangement, a slight gap may be present between surfaces 83 of crankcase 44 and 85 of non-orbiting scroll member 32.

Figure 10:
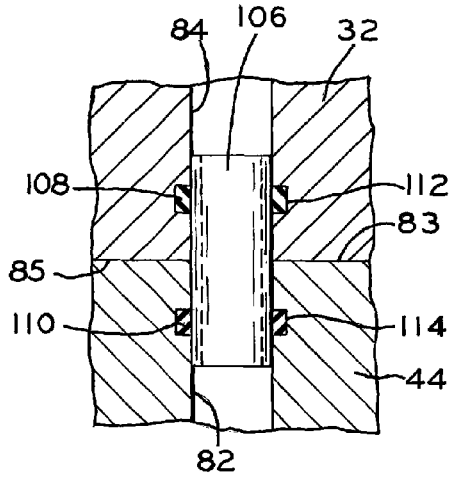
FIG. 10 is an enlarged, fragmentary view of a portion of FIG. 6A, showing a seal arrangement between the crankcase and the non-orbiting scroll passages according to a fourth embodiment.
Figure 11:
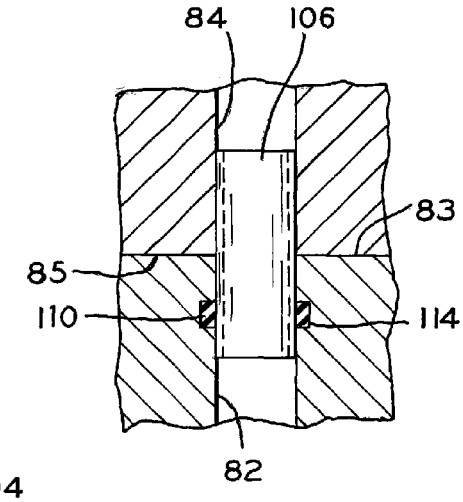
FIG. 11 is an enlarged, fragmentary view of a portion of FIG. 6A, showing a seal arrangement between the crankcase and the non-orbiting scroll passages according to a fifth embodiment.

In FIGS. 10 and 11, a connection or splice tube 106 is fitted within the adjoining ends of passages 82 and 84 formed within crankcase 44 and non-orbiting scroll member 32, respectively, and the opposite ends of tube 106 are sealed by O-ring seals 108 and 110 provided in respective recesses 112 and 114 in passages 82 and 84 as in FIG. 10 or, as shown in FIG. 11, by a single O-ring seal 110 provided in a recess 114 in passage 44 (or a single O-ring seal 108 provided in a recess 112 in passage 44). Still further, splice tube 106 may be press-fit into passages 82 and 84 without the need for separate seals. Each of the foregoing sealing arrangements provides a fluid tight seal between passages 82 and 84 at the interface of surfaces 83 of crankcase 44 and 85 of non-orbiting scroll member 32.

During operation of compressor 10, as described above, working fluid in liquid or vapor form is injected through injection fitting assembly 58 via passage 64 in injection fitting 60. The liquid working fluid then enters recess 80 in crankcase 44 and then travels via passageways 82, 84, 86, 90, and 92 and is injected into one or more intermediate pressure working pockets defined between the involute wraps 38 and 42 of non-orbiting scroll member 32 and orbiting scroll member 34.

Advantageously, as will be apparent from the above and from FIGS. 2, 5, and 6A, because passages 82, 84, 86, 90, and 92 are each formed internally with crankcase 44 and non-orbiting scroll member 32, respectively, such as by drilling the passages through the castings of these components, and the use of the sealing arrangements described above, passages 82, 84, 86, 90, and 92 are isolated from both the suction pressure chamber 50 and the discharge pressure chamber 56 defined within housing 12 of compressor 10. In other words, no seals are directly interposed between any of passages 82, 84, 86, 90, and 92 and suction pressure chamber 50 or discharge pressure chamber 56. This structural configuration minimizes the potential of the intermediate pressure working fluid in liquid or vapor form that is conveyed through passages 82, 84, 86, 90, and 92 leaking into the suction pressure chamber 50, and also minimizes any chance of discharge pressure working fluid from discharge pressure chamber 56 infiltrating passages 82, 84, 86, 90, and 92.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll compressor, comprising:

a housing;

a motor-compressor unit disposed within said housing, comprising;

a motor including a stator and a rotor;

a crankshaft fitted to said rotor;

a crankcase rotatably supporting said crankshaft;

a non-orbiting scroll member having a first involute wrap, said non-orbiting scroll member fixedly mounted with respect to said crankcase; and an orbiting scroll member having a second involute wrap, said crankshaft drivingly coupled to said orbiting scroll member to drive said orbiting scroll in an orbiting path with said first and second involute wraps cooperating to define a plurality of variable volume working pockets progressively decreasing in volume from an inlet to an outlet;

an injection inlet fitting mounted to said housing and including a first passage;

a second passage formed within said crankcase and in fluid communication with said first passage; and a third passage formed within said non-orbiting scroll member, said third passage in fluid communication with said second passage and with at least one of said variable volume working pockets;

wherein said injection inlet fitting includes a substantially planar surface, and is mounted to said housing via an adapter fitting, said adapter fitting comprising:

a first surface contacting an outer surface of said housing; and a second, substantially planar surface, said substantially planar surface of said injection inlet fitting contacting said second, substantially planar surface of said adapter fitting.

2. The scroll compressor of claim 1, wherein said adapter fitting includes a bore, and said injection inlet fitting includes a portion extending through said bore and said housing and in fluid communication with said second passage.

3. The scroll compressor of claim 1, wherein at least a portion of said non-orbiting scroll member is disposed closely adjacent at least a portion of said crankcase with a seal member captured between said portions, and said second and third passages each respectively extend to said portions and are in fluid communication with each other at said seal member.

4. The scroll compressor of claim 1, wherein said third passage further comprises first and second portions in fluid communication with each other, wherein:

said first portion is disposed substantially parallel to said crankshaft and is in fluid communication with said second passage; and said second portion is disposed substantially perpendicular to said crankshaft and includes a first open end at an outer surface of said non-orbiting scroll member and a second end in fluid communication with said variable volume working pockets.

5. The scroll compressor of claim 4, further comprising a plug received within said open first end of said second portion.

6. The scroll compressor of claim 1, wherein said plurality of variable volume working pockets includes at least one intermediate pressure working pocket, said third passage in fluid communication with said at least one intermediate pressure working pocket.

7. The scroll compressor of claim 1, wherein said non-orbiting scroll member divides an interior of said housing into a relatively low, suction pressure chamber in which said motor-compressor unit is disposed, and a relatively high, discharge pressure chamber.

8. A scroll compressor, comprising:

a housing;

a motor-compressor unit disposed within said housing, comprising;

a motor including a stator and a rotor;

a crankshaft fitted to said rotor;

a crankcase rotatably supporting said crankshaft;

a non-orbiting scroll member having a first involute wrap, said non-orbiting scroll member fixedly mounted with respect to said crankcase; and an orbiting scroll member having a second involute wrap, said crankshaft drivingly coupled to said orbiting scroll member to drive said orbiting scroll in an orbiting path with said first and second involute wraps cooperating to define a plurality of variable volume working pockets progressively decreasing in volume from an inlet to an outlet;

an injection inlet fitting mounted to said housing and including a first passage;

a second passage formed within said crankcase and in fluid communication with said first passage; and a third passage formed within said non-orbiting scroll member, said third passage in fluid communication with said second passage and with at least one of said variable volume working pockets;

wherein at least a portion of said non-orbiting scroll member is in direct abutment with at least a portion of said crankcase at an abutment interface, and said second and third passages each respectively extend to said abutment interface and are in fluid communication with each other at said abutment interface.

9. The scroll compressor of claim 8, further comprising at least one seal member disposed at said abutment interface.

10. A scroll compressor, comprising:

a housing;

a motor-compressor unit disposed within said housing, comprising:, a motor including a stator and a rotor;

a crankshaft fitted to said rotor;

a crankcase rotatably supporting said crankshaft;

a non-orbiting scroll member having a first involute wrap, said non-orbiting scroll member fixedly mounted with respect to said crankcase; and an orbiting scroll member having a second involute wrap, said crankshaft drivingly coupled to said orbiting scroll member to drive said orbiting scroll in an orbiting path with said first and second involute wraps cooperating to define a plurality of variable volume working pockets progressively decreasing in volume from an inlet to an outlet;

an injection inlet fitting mounted to said housing and including a first passage;

a second passage formed within said crankcase and in fluid communication with said first passage; and a third passage formed within said non-orbiting scroll member, said third passage in fluid communication with said second passage and with at least one of said variable volume working pockets;

wherein said third passage further comprises first and second portions in fluid communication with each other:

said first portion is disposed substantially parallel to said crankshaft and is in fluid communication with said second passage; and said second portion is disposed substantially perpendicular to said crankshaft and includes a first open end at an outer surface of said non-orbiting scroll member and a second end in fluid communication with said variable volume working pockets; and wherein said compressor further comprises an end cap fitted over said non-orbiting scroll member and covering said open first end of said second portion.

11. A scroll compressor, comprising:

a housing;

an end cap fitted to said housing;

an injection inlet fitting mounted to said housing;

a motor-compressor unit disposed within said housing, comprising;

a motor including a stator and a rotor;

a crankshaft fitted to said rotor;

a crankcase rotatably supporting said crankshaft;

a non-orbiting scroll member, comprising:

a first involute wrap; and a first passage formed within said non-orbiting scroll member and in fluid communication with said injection inlet, said first passage including an open end at an outer surface of said non-orbiting scroll member, said end cap covering said open end; and an orbiting scroll member having a second involute wrap, said crankshaft drivingly coupled to said orbiting scroll member to drive said orbiting scroll in an orbiting path with said first and second involute wraps cooperating to define a plurality of variable volume working pockets progressively decreasing in volume from an inlet to an outlet, at least one of said variable volume working pockets in fluid communication with said first passage.

12. The scroll compressor of claim 11, further comprising a plug received within said open end of said first passage.

13. The scroll compressor of claim 11, further comprising a second passage formed within said crankcase, said second passage fluidly communicating said injection inlet fitting and said first passage.

14. The scroll compressor of claim 11, wherein said non-orbiting scroll member is fixedly mounted with respect to said crankcase.

15. The scroll compressor of claim 11, wherein at least a portion of said non-orbiting scroll member is in direct abutment with at least a portion of said crankcase at an abutment interface, and said first and second passages each respectively extend to said abutment interface and are in fluid communication with each other at said abutment interface.

16. The scroll compressor of claim 15, further comprising at least one seal member disposed at said abutment interface.

17. The scroll compressor of claim 11, wherein at least a portion of said non-orbiting scroll member is disposed closely adjacent at least a portion of said crankcase with a seal member captured between said portions, and said first and second passages each respectively extend to said portions and are in fluid communication with each other at said seal member.

18. The scroll compressor of claim 11, wherein said non-orbiting scroll member divides an interior of said housing into a relatively low, suction pressure chamber in which said motor-compressor unit is disposed, and a relatively high, discharge pressure chamber.

* * * * *